United States Patent [19]

Meyers et al.

[11] 4,124,160

[45] Nov. 7, 1978

[54] ROUND TRAY

[75] Inventors: George L. Meyers; Russell R. Webb, both of Menasha, Wis.

[73] Assignee: American Can Company, Greenwich, Conn.

[21] Appl. No.: 820,315

[22] Filed: Jul. 29, 1977

[51] Int. Cl.[2] ..... B65D 5/24; B65D 3/04

[52] U.S. Cl. ..... 229/21; 229/1.5 B; 229/8

[58] Field of Search ..... 229/1.5 B, 21, 31, 8

[56] References Cited

U.S. PATENT DOCUMENTS

| | | | |
|---|---|---|---|
| 1,497,661 | 6/1924 | Scotcher | 229/21 |
| 2,050,894 | 8/1936 | Paige | 229/8 X |
| 2,385,898 | 10/1945 | Waters | 229/1.5 B X |
| 2,758,771 | 8/1956 | Bauer | 229/1.5 B |
| 2,925,208 | 2/1960 | Wood | 229/1.5 B |
| 2,966,293 | 12/1960 | Goldsholl | 229/8 X |
| 3,363,747 | 1/1968 | Nowak | 229/8 X |
| 3,381,877 | 5/1968 | Arneson | 229/21 |
| 3,733,023 | 5/1973 | Arneson | 229/21 |

*Primary Examiner*—Davis T. Moorhead
*Attorney, Agent, or Firm*—Robert P. Auber; Ira S. Dorman; Ernest L. Brown

[57] ABSTRACT

A round tray and a blank for making the tray. The tray has a bottom panel, a plurality of intermediate panels symetrically disposed about the center of the bottom panel, and a plurality of upstanding panels to form the sides of the tray. The upstanding panels may be tilted slightly outward in a conical shape to cause the diameter of the top of the tray to be slightly larger than the diameter of the bottom of the tray. Alternate ones of the upstanding panels are positioned on the inside of the tray, and their adjacent upstanding panels have circumferentially extending glue flaps which overlap the inner panels. The total number of upstanding panels and the total number of intermediate panels are equal, with each upstanding panel being foldable relative to an intermediate panel immediately below it about a first set of fold or score lines. The intermediate panels, in turn, are folded upward from the horizontal about a second set of fold or score lines. The boundaries of the intermediate panels are each formed by a score line from the first set and a score line from the second set of score lines, the first and second score lines of a particular panel coming together at points on the edges of the intermediate panel and on the edges of the upstanding panels. A point of intersection of the first and second score lines which define the edges of an intermediate panel is also the point of intersection for the first and second score lines of the next adjacent intermediate panel. Those points of intersection are formed on a circle about the center of the base panel but elevated slightly above the plane of the base panel.

3 Claims, 9 Drawing Figures

FIG. 6
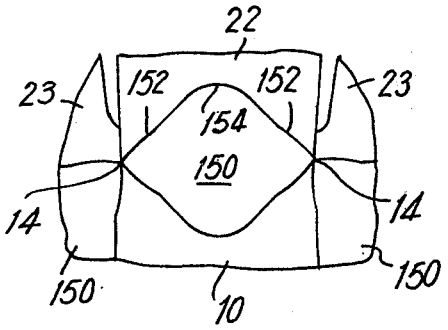
FIG. 7
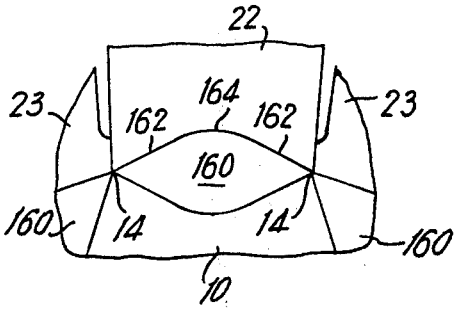
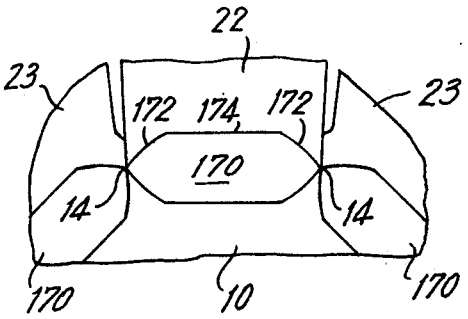
FIG. 8
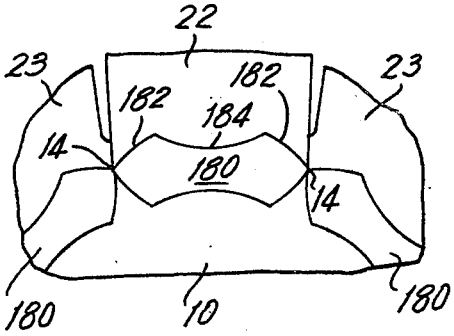
FIG. 9

ROUND TRAY

BACKGROUND OF THE INVENTION

To obtain round trays for the baking of cakes such as angel food cakes, and the like, the tray is customarily made in two pieces, a round bottom and curved sides which are then glued together. That is, two separate blanks are processed, folded, and glued together.

When a single blank has been used, the sides have been upstanding from the bottom and folded upward about curved fold lines from the bottom, which typically caused the entire bottom to curl and not lie flat. Alternatively, when straight fold scores were used, the bottom had an undesired polygonal shape.

In upside-down cakes, such as angel food cakes, it is desirable to have the top of the cake substantially flat and to have the top also appear to be substantially rounded.

BRIEF DESCRIPTION OF THE INVENTION

The article of this invention is a round tray which is made from a one piece blank. By putting a hole in the center of the tray and putting a paper cup upward through the hole into the tray, an angel food cake pan or box is produced. The angel food cake or upside-down cake, with the article of this invention, has a substantially flat top because the central portion of the bottom of the tray is substantially flat. The sides of the formed tray are either cylindrical or conical, and to that end a plurality of upstanding panels are provided which form such a cylindrical or conically shaped tray having a round top. Between the bottom panel of the tray and the panels forming the side of the tray are a plurality of intermediate panels. With the particularly shaped intermediate or transition panels, the bottom of the tray appears substantially round, lies flat, and also has a substantially round at the top.

When assembled, the intermediate panels are angled upward from the horizontal but not to the extent of the upstanding side panels of the tray. Score lines are made between the bottom panel of the tray and the intermediate panels and another set of score lines is provided between the intermediate panels and the upstanding panels. The intermediate panels are of several alternative shapes which have generally arcuate boundaries. The intermediate panels are symetrically disposed about the center of the bottom panel and are substantially identical. The intermediate panels touch at point contacts, and the point contacts from a circle which is elevated slightly above the bottom panel.

When assembled, alternative ones of the upstanding side panels are positioned on the interior of the tray. The remaining ones of the upstanding side panels have circumferentially directed glue flaps which overlap the inner upstanding side panels and which preferably extend to the point where they abut and partially cover the inner upstanding panels.

Alternatively the panels with glue flaps may be placed on the inside of the assembled tray with the adjacent panels being glued to the outside of and covering the glue flaps.

It is therefore an object of this invention to provide a tray which is substantially circular at the top and which appears to be substantially circular at the bottom, wherein most of the bottom of the tray lies flat and the tray has a plurality of intermediate panels between the bottom and the upstanding side panels.

BRIEF DESCRIPTION OF THE DRAWINGS

Other objects will become apparent from the following description, taken in connection with the accompanying drawings, in which:

FIG. 6 shows a second alternative embodiment of the intermediate panels of the carton of this invention;

FIG. 7 shows a third embodiment of the intermediate panels of the tray of this invention;

FIG. 8 shows a fourth embodiment of the intermediate panels of a tray in accordance with this invention;

FIG. 9 shows a fifth embodiment of the intermediate panels of a tray in accordance with this invention;

DETAILED DESCRIPTION OF THE INVENTION

Figure 1:
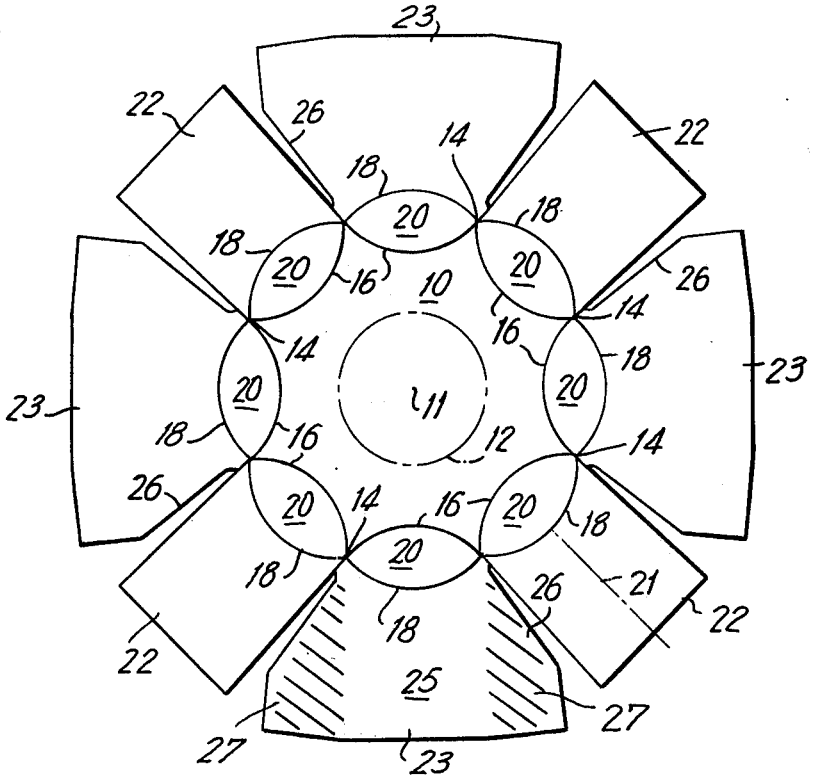
FIG. 1 is a drawing of a one piece blank in accordance with a most preferred embodiment of this invention.
Figure 2:
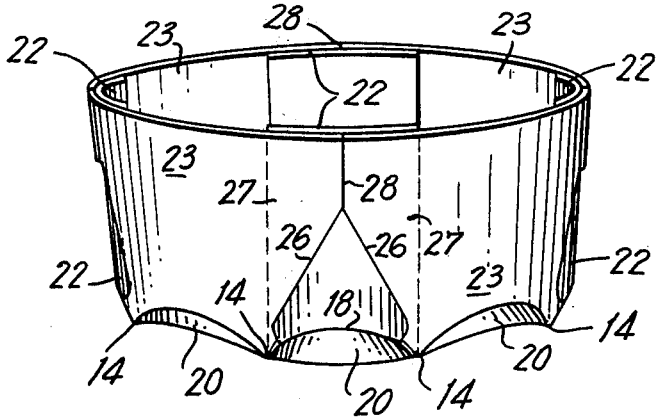
FIG. 2 is a first perspective view of the round tray made from the blank of FIG. 1.
Figure 3:
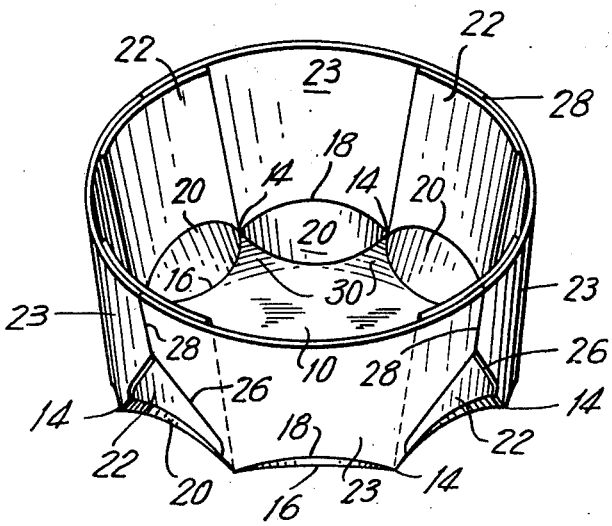
FIG. 3 is a second perspective view of the round tray of FIG. 2.

The preferred embodiment of the invention is shown in FIGS. 1, 2 and 3. FIG. 1 shows a one piece blank from which the preferred embodiment is made, and FIGS. 2 and 3 show oblique views of the assembled tray.

Referring to FIG. 1, the bottom panel 10 is circularly symetrical about the center point 11. When a tray for making an angel food cake is desired, the hole designated 12 may be cut out, and upstanding paper cups inserted through the hole 12 into the tray to form the center mandrel for an angel food cake.

A plurality of points 14 are defined on a circle whose center is at 11 and which has a predetermined radius. The adjacent points 14 are connected by two sets of score lines about which the tray is folded. The first set of bottom score lines are shown at 16. The second set of top score lines are shown at 18. Between the score lines 16 and 18 are a plurality of intermediate panels 20.

In the preferred embodiment of FIGS. 1, 2 and 3, there are eight points 14 on a circle centered at 11, and there are eight substantially identical intermediate panels 20. The panels 20 are symetrically arranged in a circle around the center 11. In the preferred embodiment of FIGS. 1, 2 and 3, the set of score lines 16 have the same curvature as the set of score lines 18, and the score lines are segments of circles whose centers are on the line of symmetry 21 which is shown in FIG. 1. A more detailed discussion of the shape of the preferred embodiment of the intermediate panels 20 of FIGS. 1, 2 and 3 is deferred to a more complete discussion below.

A plurality of side panels, equal in number to the number of intermediate panels 20 are shown at 22 and 23. The panels 22 and 23 are foldable about the hinge lines 18 into a cylindrical tray or into a conical tray as shown more particularly in FIGS. 2 and 3. Note that the upstanding panels 22 are each between a pair of upstanding panels 23. Similarly, each of the panels 23 are between a pair of panels 22. One of the flaps 23 in FIG. 1 is shown divided into three segments, a central segment 25 which is substantially identical in size and shape to the panels 22 and a pair of glue flaps 27 which overlap the outside of panels 22 as shown more particularly in FIGS. 2 and 3 when the tray is assembled. Alternatively, the outside of the glue flaps 27 could be covered with glue and the flaps 22 placed outside of the panels 23. Each of the panels 23 has a pair of glue flaps 27 although the glue is not shown on the other flaps.

The intermediate panels 20 are foldable about the score lines 16 relative to the bottom panel 10. The upstanding wall panels 22 and 23 are foldable about the score lines 18 to form the walls of the tray as shown in FIGS. 2 and 3.

As shown in FIGS. 2 and 3, the slanting of the edges of panels 23 as shown at 26 is desirable so that the tray may be made in one piece. Note in FIG. 1 that the edge 26 needs to be slanted to avoid interference with the adjacent panel 22. When the tray is assembled, the slanting of the edge of the panel 23 becomes decorative. Note that the glue panels 27 in FIGS. 2 and 3 overlap the panel 22 and preferably the edges of the panels 23 abut as shown at 28.

Figure 4:
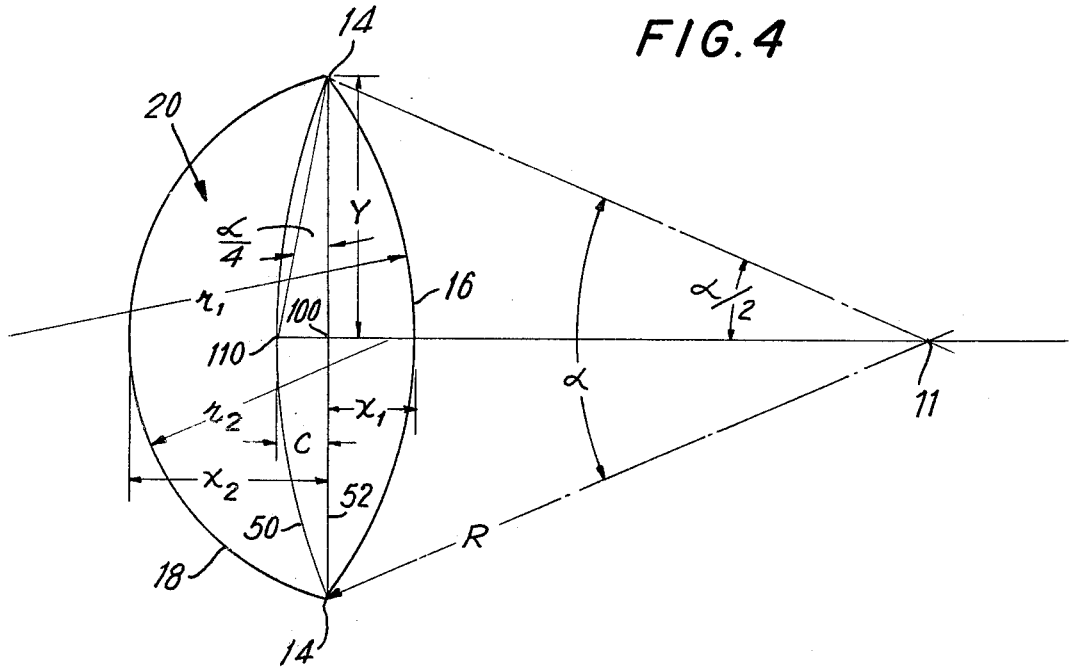
FIG. 4 is a diagram useful in explaining a preferred embodiment of the invention.
Figure 5:
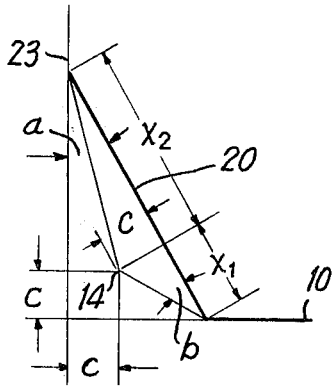
FIG. 5 is a second diagram used in explaining a preferred embodiment of the invention.

The bottom panel 10 lies flat over most of its surfaces, but it tilts up in the region 30 adjacent the intermediate panels 30 to meet the points 14 which are elevated slightly from the bottom panel as shown more particularly in FIG. 3. p It should be noted that the score marks 16 and the score marks 18 need not be the same either in shape or in radius of curvature. FIGS. 4 and 5 demonstrate the geometry of the intermediate panels 20 when the radii of curvature of the score marks 16 is different than the radii of curvature of the score marks 18.

Referring to FIGS. 4 and 5, the plane of the intersection points 14 is a distance "*c*" above the bottom panel 10. The radius from the center point 11 to the intersection points 14 is a distance "R". With eight intermediate panels 20 arranged around the center 11, the angle "$\alpha$" is 45°.

An arc segment with center at 11 is formed through the consecutive points 14 as shown at 50 in FIG. 4. A chord 52 of that arc is drawn connecting points 14 and 14.

In the construction of FIGS. 4 and 5, it is assumed that the upstanding walls 22 and 23 are vertical and cylindrical. Actually, as shown, they are slightly conical but the description of the construction is facilitated by assuming that they are cylindrical and the approximation is sufficiently accurate when using cardboard, and the like.

In FIG. 5 the line 23 represents the outside cylinder of the upstanding walls. In any event, whether the upstanding walls are cylindrical or flared into a conical shape, the intermediate panels 20 may be represented as shown in FIG. 4, and the inclination of the intermediate panels from the horizontal and the vertical is shown in FIG. 5. In a most preferred embodiment, the distances $x_1$ and $x_2$ are equal.

It is a well known formula from planar geometry that the radius of a circle is equal to the square of the length of a chord plus four times the square of the distance perpendicular to the chord from the center of the chord to the arc of the circle all divided by eight times the perpendicular distance from the chord at the center of the chord to the arc of the circle. In the figure, the length of the chord is given as $2y$. The perpendicular distances from the center of the chord to the two arc boundaries of panel 20 are designated $x_1$ and $x_2$. Substituting these factors into the general equation, the radii $r_1$ and $r_2$ of the boundaries of the preferred intermediate panel 20 are determined to be:

$$y^2 + x_1^2/2x_1 = r_1 \text{ and}$$

$$y^2 + x_2^2/2x_2 = r_2$$

In a most preferred embodiment, as shown in FIGS. 1, 2, $x_1$ equals $x_2$.

The relation between the semichord length $y$, the radius from points 11 to 14, designated R, and the central angle "$\alpha$" of the chord is that $$y = R \sin(\alpha/2)$$

The angle 110-14-100 in FIG. 4 is equal to $\alpha/4$. That is, the angle between a chord of a circle having a central angle $\alpha$ and a chord of a circle having a central angle $\alpha/2$ is equal to $\alpha/4$.

From that relation, distance "*c*", which is the height of the circle 14 above the bottom panel 10 is equal to $y$ times the tangent of $\alpha/4$.

The angle through which panels 20 are folded upward from the base panel 10 is designated "*b*", and its complement is designated "*a*". From FIG. 5, it may be seen that $x_1$ is equal to $c$ times the cotangent of $b/2$, and $x_2$ is equal to $c$ times the cotangent of $a/2$.

Let "*n*" be the number of intermediate panels 20. Then, $y = R \sin(360°/2n)$ and $c = y \tan(360°/4n)$. Substituting into the equation for "*c*" the value of "*y*", $c = R \sin(360°/2n) \tan(360°/4n)$ and $x_1 = c \cot(b/2) = R \sin(360°/2n) \tan(360°/4n) \cot(b/2)$ and $x_2 = c \cot(a/2) = R \sin(360°/2n) \tan(360°/4n) \cot(a/2)$ Substituting in the geometric identity $r = x^2 + y^2/2x$, the general formula is obtained $$r_1 = \frac{R \sin(360°/2n)\left[\tan(360°/4n)\left(\cot\left(\frac{b}{2}\right)\right)\right]^2 + R \sin(360°/2n)}{2 \tan(360°/4n) \cot\left(\frac{b}{2}\right)}$$

and $$r_2 = \frac{R \sin(360°/2n)\left[\tan(360°/4n) \cot\left(\frac{a}{2}\right)\right]^2 + R \sin(360°/2n)}{2 \tan(360°/4n) \cot\left(\frac{a}{2}\right)}$$

In the special case of FIGS. 1-3 where $a$ equals $b$ equals 45°, $r_1$ equals $r_2$ equals 0.490 R.

Note that when the carton is set up, the points 14 move closer to the point 11 due to the curvature of the bottom panel 10 in the region of 30. Therefore, a small amount must be added to the circle diameter R to achieve a given radius of the set up carton.

FIGS. 6, 7, 8 and 9 show some alternative embodiments of the invention wherein the intermediate panel assumes shapes which are not the optimum shapes but which are decorative and have some of the features of the optimum shape. Particularly, the various shaped intermediate panels shown in FIGS. 6, 7, 8 and 9 allow the bottom panel 10 to lie substantially flat, and the blank may be made in one piece. In each of the figures, only a small portion of the blank is shown to show the modification of the intermediate panel. Although each of the panels are shown with symmetrical boundaries, it is not necessary that the boundaries neither be symmetrical nor identical.

Referring to FIG. 6, the boundary for the intermediate panel 150 may be straight or arcuate in the end regions 152 and arcuate with a different curvature in the central region 154.

In the embodiments shown in FIG. 7, the intermediate panel 160 is shown with straight lines in the end regions 162 and a curved line in the central region 164.

In FIG. 8, the intermediate panel 170 is shown with an arcuate boundary in the end regions 172 and a straight boundary in the central region 174.

In FIG. 9, the intermediate panel 180 is shown with an arcuate boundary in the end regions 182 and an arcuate boundary with an opposite sense of curvature in the central region 184. That is, if one calls the curvature in the region 182 positive, the curvature in the region 184 then would be designated as negative.

In the embodiments of FIGS. 6, 7, 8 and 9, it is desirable and in some cases may be necessary to relieve the regions where the curvature changes abruptly so that tearing may be avoided.

Thus, the tray of this invention is easily fabricated from a one piece blank, and it has a bottom panel which lies flat over most of its central region. A plurality of intermediate panels are positioned symmetrically about the center of the bottom panel to provide a transition between the plane of the bottom panel and the surface of the upstanding side panels which may be cylindrical or conical when glued together. To that end, the bottom panels and intermediate panels as well as the side panels and the intermediate panels are separated by score lines about which the various panels may be folded.

Note that two trays of the same size, each having a cylindrical side wall, may be placed one on top of the other so that one becomes a tray and the other a lid.

Although the invention has been described in detail above, it is not intended that the invention should be limited by that description but only by the specification in combination with the appended claims.

We claim:

1. A blank for a round tray comprising:

a bottom panel whose boundary is defined by a plurality of points of equal radii, R, from the center of said panel and uniformly distributed circumferentially about said center and by a first set of score lines in the form of arcs of circles, having radii $r_1$, whose centers are positioned outward from said first set of score lines on radii extending from the center of said bottom panel, said score lines of said first set connecting adjacent said points;

a plurality of intermediate panels between said points and equal in number to said points, the boundary of each said intermediate panel being defined on the bottom by one of said first set of score lines and on the top by a score line from a second set of score lines in the form of arcs of circles, having radii $r_2$, whose centers are positioned inward from said second set of score lines on radii extending from the center of said bottom panel, the score lines of said second set of score lines connecting said adjacent points;

$r_1$ and $r_2$ being defined by the following equations $$r_1 = \frac{R \sin(360°/2n)\,[\tan(360°/4n)\cot(\frac{b}{2})]^2 + R\sin(360°/2n)}{2\tan(360°/4n)\cot(\frac{b}{2})}$$

and $$r_2 = \frac{R \sin(360°/2n)\,[\tan(360°/4n)\cot(\frac{a}{b})]^2 + R\sin(360°/2n)}{2\tan(360°/4n)\cot(\frac{a}{2})}$$

wherein $n$ is the number of intermediate panels, $b$ is the elevation angle of each intermediate panel relative to the bottom panel, $a$ is the complementary angle of $b$; and a plurality of wall panels whose boundaries are defined on the bottom by a score line of said second set of score lines.

2. A blank as recited in claim 1 in which $a = b = 45$ degrees, $n =$ eight, and $r_1 = r_2$.

3. A round tray made from the blank of claim 2.

* * * * *